US006435258B1

(12) United States Patent
Ogasawara et al.

(10) Patent No.: US 6,435,258 B1
(45) Date of Patent: Aug. 20, 2002

(54) METHOD AND APPARATUS FOR COOLING MOLD

(75) Inventors: Akihiko Ogasawara, Omiya; Kiyonobu Mizoue; Kenta Haraguchi, both of Utsunomiya; Shuji Kobayashi, Tochigi-ken; Tetsuya Yamamoto; Masashi Sato, both of Hamamatsu, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/558,546

(22) Filed: Apr. 26, 2000

(51) Int. Cl.[7] ..... B22D 27/04
(52) U.S. Cl. ..... 164/128; 164/302; 164/348
(58) Field of Search ..... 164/348, 128, 164/312, 113, 134, 119, 465, 421, 448, 302

(56) References Cited

U.S. PATENT DOCUMENTS 4,071,081 A * 1/1978 Chielens et al. ..... 165/82
4,471,830 A * 9/1984 Sevastakis ..... 164/421
4,631,792 A * 12/1986 Wesemann et al. ..... 29/129
4,658,884 A * 4/1987 Euler et al. ..... 164/443
4,693,293 A * 9/1987 Yamamoto et al. ..... 164/99
5,209,283 A * 5/1993 Miltzow et al. ..... 164/448
5,642,772 A * 7/1997 Charpentier et al. ..... 164/485
5,896,912 A * 4/1999 Monroe et al. ..... 164/314

* cited by examiner

*Primary Examiner*—M. Alexandra Elve
*Assistant Examiner*—Len Tran
(74) *Attorney, Agent, or Firm*—Birch, Stewart Kolasch & Birch, LLP

(57) ABSTRACT

A cooling passage is formed to have a helical configuration so that a flow rate of a cooling medium supplied to the cooling passage is controlled to be in an optimum cooling region. Accordingly, the contact surface area and the cooling volume of cooling water are decreased respectively. Further, it is possible to stably obtain an optimum casting quality with ease.

15 Claims, 13 Drawing Sheets

FIG.9

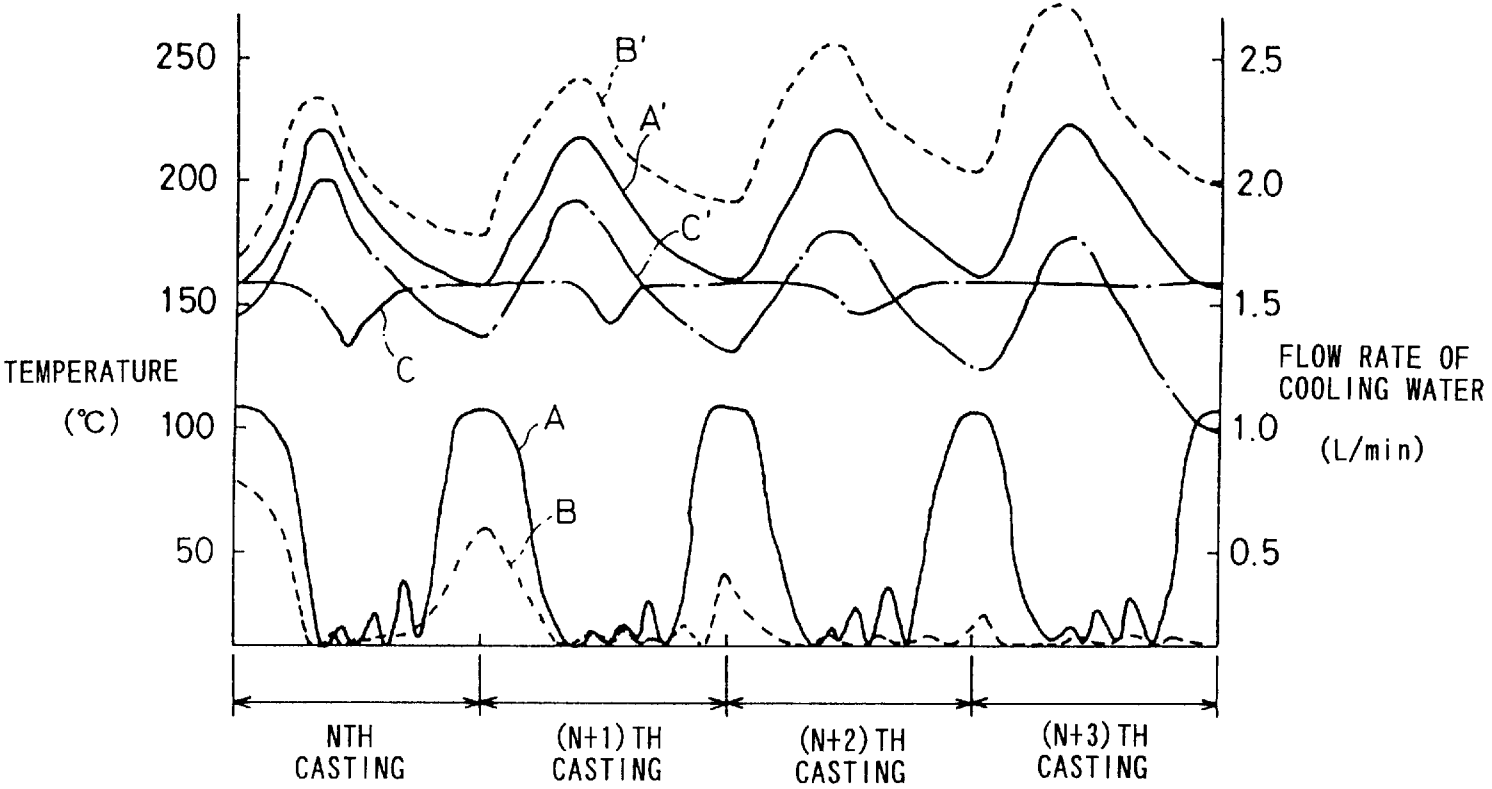

A : CHANGE OF FLOW RATE AT FLOW VELOCITY OF 1.1 LITER PER MINUTE
A' : TEMPERATURE CHARACTERISTIC OF MOLD AT FLOW VELOCITY DESCRIBED ABOVE
B : CHANGE OF FLOW RATE AT FLOW VELOCITY OF 0.8 LITER PER MINUTE
B' : TEMPERATURE CHARACTERISTIC OF MOLD AT FLOW VELOCITY DESCRIBED ABOVE
C : CHANGE OF FLOW RATE AT FLOW VELOCITY OF 1.6 LITER PER MINUTE
C' : TEMPERATURE CHARACTERISTIC OF MOLD AT FLOW VELOCITY DESCRIBED ABOVE

A :CHANGE OF FLOW RATE AT FLOW VELOCITY OF 1.1 LITER PER MINUTE
A' :TEMPERATURE CHARACTERISTIC OF MOLD AT FLOW VELOCITY DESCRIBED ABOVE
A'' :TEMPERATURE CHARACTERISTIC OF COOLING WATER AT FLOW VELOCITY DESCRIBED ABOVE

D :CHANGE OF FLOW RATE AT FLOW VELOCITY OF 1.4 LITER PER MINUTE
D' :TEMPERATURE CHARACTERISTIC OF MOLD AT FLOW VELOCITY DESCRIBED ABOVE
D'' :TEMPERATURE CHARACTERISTIC OF COOLING WATER AT FLOW VELOCITY DESCRIBED ABOVE

E :CHANGE OF FLOW RATE AT FLOW VELOCITY OF 0.9 LITER PER MINUTE
E' :TEMPERATURE CHARACTERISTIC OF MOLD AT FLOW VELOCITY DESCRIBED ABOVE
E'' :TEMPERATURE CHARACTERISTIC OF COOLING WATER AT FLOW VELOCITY DESCRIBED ABOVE

FIG.18

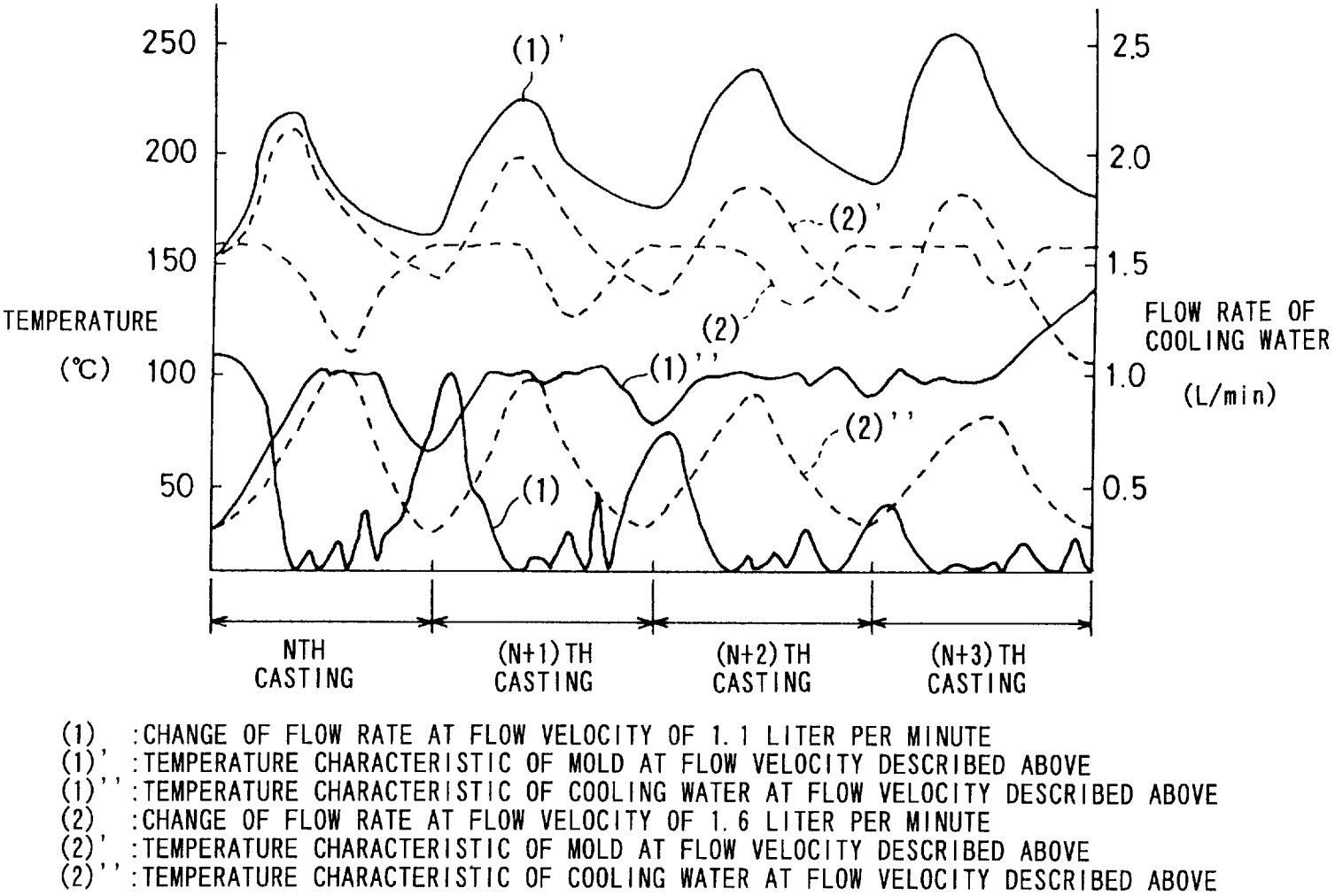

(1) :CHANGE OF FLOW RATE AT FLOW VELOCITY OF 1.1 LITER PER MINUTE
(1)' :TEMPERATURE CHARACTERISTIC OF MOLD AT FLOW VELOCITY DESCRIBED ABOVE
(1)'' :TEMPERATURE CHARACTERISTIC OF COOLING WATER AT FLOW VELOCITY DESCRIBED ABOVE
(2) :CHANGE OF FLOW RATE AT FLOW VELOCITY OF 1.6 LITER PER MINUTE
(2)' :TEMPERATURE CHARACTERISTIC OF MOLD AT FLOW VELOCITY DESCRIBED ABOVE
(2)'' :TEMPERATURE CHARACTERISTIC OF COOLING WATER AT FLOW VELOCITY DESCRIBED ABOVE

METHOD AND APPARATUS FOR COOLING MOLD

BACKGROUND OF THE INVENTION

1. Field of the Invention

The present invention relates to a method and an apparatus for cooling a mold when a cavity of the mold is filled with molten metal to perform casting.

2. Description of the Related Art

A casting method for obtaining a cast product having a desired shape has been hitherto performed by charging molten metal into a cavity formed in a mold and solidifying the molten metal. In this process, a cooling apparatus is usually provided in order that the molten metal charged in the cavity is smoothly solidified and the mold is cooled.

FIGS. 14 to 17 show a cooling apparatus concerning the conventional technique for casting a cast product having a bottom-equipped cylindrical configuration.

The cooling apparatus 1 comprises a core pin 3 which has a hollow section 2 formed at the inside, a supply tube 4 which faces the hollow section 2 and which supplies cooling water to the hollow section 2, and a discharge port 5 which communicates with the hollow section 2 and through which the cooling water stored in the hollow section 2 is discharged.

Reference numeral 6 indicates the cast product cast by using an unillustrated mold.

FIGS. 14 and 15 are illustrative of a case which adopts the core pin 3 having a lateral typeicooling structure. FIGS. 16 and 17 are illustrative of a case which adopts the core pin 3 having a vertical type cooling structure.

FIG. 18 shows the relationship between the temperature and the flow rate of the cooling water, obtained when the continuous casting is performed by using the cooling apparatus 1 concerning the conventional technique.

In FIG. 18, a solid line (1) indicates the change of the flow rate obtained when the flow rate of the cooling water supplied to the cooling apparatus 1 is constant at a flow velocity of 1.1 liter per minute. A solid line (1)' indicates the temperature characteristic of the mold obtained when the flow velocity is constant at 1.1 liter per minute. The solid line (1)" indicates the temperature characteristic of the cooling water obtained when the flow velocity is constant at 1.1 liter per minute.

In FIG. 18, a broken line (2) indicates the change of the flow rate obtained when the flow rate of the cooling water supplied to the cooling apparatus 1 is constant at a flow velocity of 1.6 liter per minute. A broken line (2)' indicates the temperature characteristic of the mold obtained when the flow velocity is constant at 1.6 liter per minute. The broken line (2)" indicates the temperature characteristic of the cooling water obtained when the flow velocity is constant at 1.6 liter per minute.

In FIG. 18, when the casting is continuously performed, then the Nth casting is indicated by "Nth", and the followings are continuously represented by "(N+1)th", "(N+2)th", and "(N+3)th".

However, the cooling apparatus 1 concerning the conventional technique involves such an inconvenience that the cooling water is evaporated during the casting due to the difference between the volume in the hollow section 2 and the flow rate of the cooling water supplied from the supply tube 4. As a result, the cooling ability is lowered due to the steam generated in the hollow section 2.

That is, an inconvenience arises such that a space 7 is formed by the layer of air and steam generated on the upper side of the hollow section 2. Consequently, the cooling becomes uneven, and the cooling efficiency is lowered. For example, as depicted by the solid line (1)" in FIG. 18, in the (N+3)th casting, the temperature of the cooling water, which is obtained at the flow velocity of 1.1 liter per minute, exceeds 100° C., and the cooling water is converted into steam.

The decrease in cooling ability causes the following inconvenience. That is, an overheat portion 8 suffers occurrence of the so-called sink mark which badly affects the cast product and the so-called capture in which a surface portion of the cast product adheres to the mold. For example, as depicted by the solid line (1)' in FIG. 18, in the (N+3)th casting, the temperature of the mold is quickly raised at the flow velocity of 1.1 liter per minute, and the mold is excessively heated. As a result, the sink mark and the capture occur.

In the conventional technique, the decrease in cooling ability as described above is dealt with the increase in amount of the cooling water to a great extent. However, when the amount of cooling water is increased, then the mold is in an excessively cooled state, and-the molten metal charged in the cavity is quickly cooled. Therefore, another inconvenience arises such that the misrun or the like takes place. For example, as depicted by the broken line (2)' in FIG. 18, in the (N+3)th casting, the temperature of the mold is quickly lowered at the flow velocity of 1.6 liter per minute, and the mold is excessively cooled. As a result, the misrun occurs.

SUMMARY OF THE INVENTION

A general object of the present invention is to provide a method and an apparatus for cooling a mold, which make it possible to easily obtain an optimum casting quality in a stable manner by decreasing the contact surface area and the cooling volume of the cooling medium A principal object of the present invention is to provide a method and an apparatus for cooling a mold, which make it possible to easily obtain an optimum casting quality in a stable manner by providing the directivity of cooling corresponding to the wall thickness of a cast product.

The above and other objects, features, and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 9 illustrates a relationship between the temperature and the flow rate of cooling water, obtained when the continuous casting is performed by using the mold;

FIG. 18 illustrates a relationship between the temperature and the flow amount of cooling water, obtained when the continuous casting is performed by using the cooling apparatus concerning the conventional technique.

DESCRIPTION OF THE PREFERRED EMBODIMENTS

Figure 1:
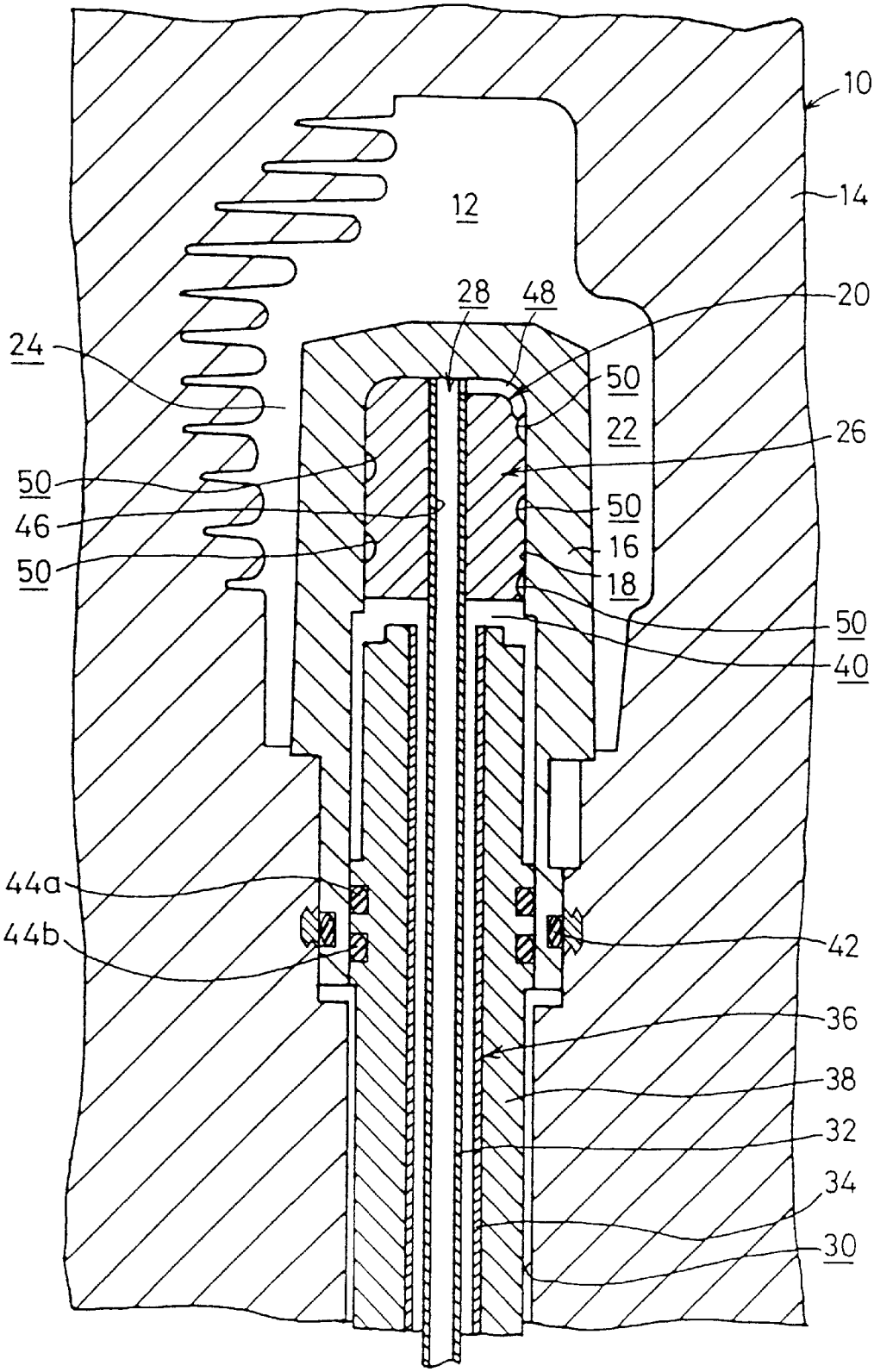
FIG. 1 shows a longitudinal sectional view illustrating a mold to which a mold-cooling apparatus according to an embodiment of the present invention is!applied.

With reference to FIG. 1, reference numeral 10 indicates a mold to which a mold-cooling apparatus according to an embodiment of the present invention is applied.

The mold 10 is used to produce a cylinder block for an automobile engine. The mold 10 comprises a main mold body 14 which is formed with a cavity 14 having a configuration corresponding to the cylinder block, a bore-forming core pin 16 which is inserted into the main mold body 14 to form a bore of the cylinder block, and a mold-cooling apparatus 20 which is inserted into a hole 18 of the bore-forming core pin 16.

The cavity 12 is arranged substantially symmetrically while the bore-forming core pin 16 intervenes therein. The cavity 12 includes a first cavity 22 for forming a thick-walled section of the cylinder block, by means of the casting, and a second cavity 24 for forming a thin-walled section of the cylinder block.

Figure 3:
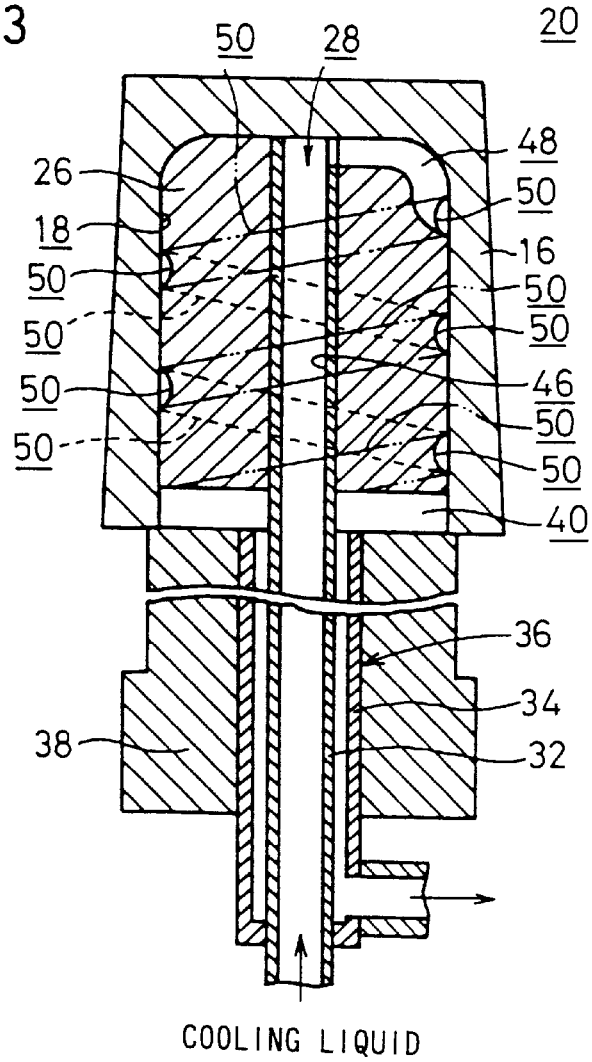
FIG. 3 shows a longitudinal sectional view illustrating the mold-cooling apparatus inserted into a hole of a core pin.
Figure 4:
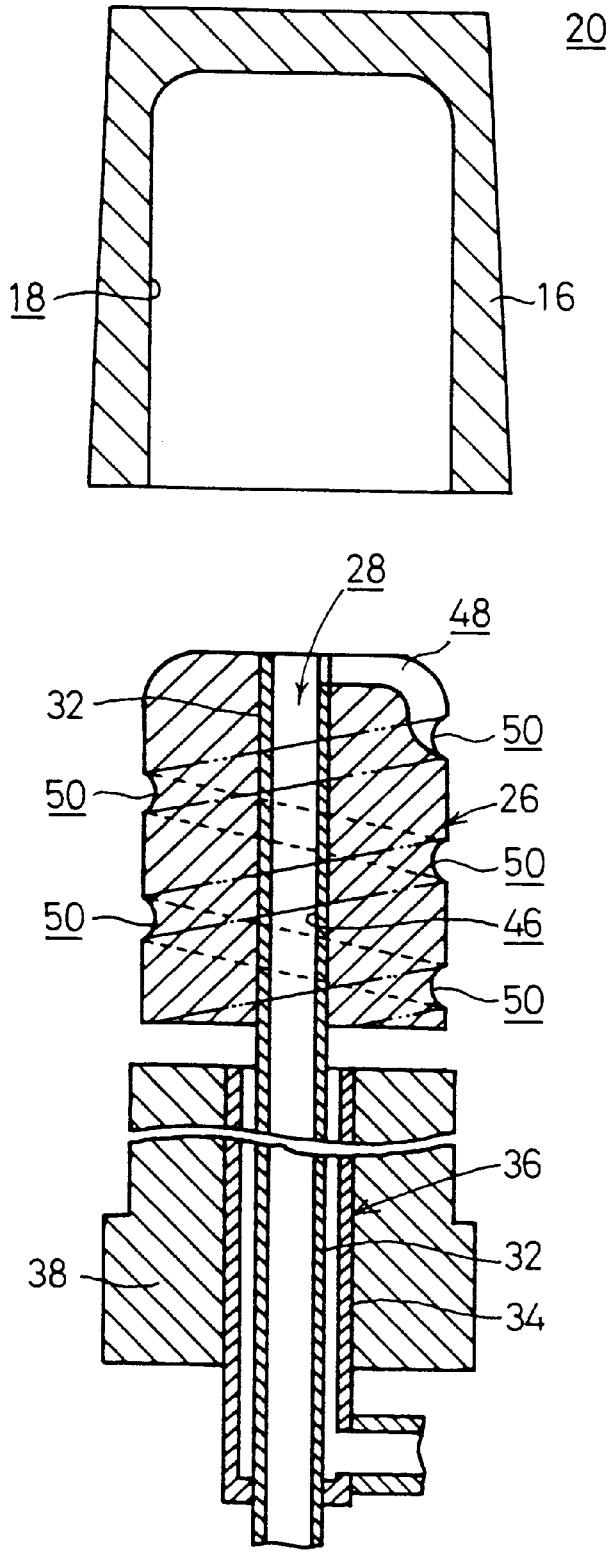
FIG. 4 shows an exploded longitudinal sectional view illustrating the mold-cooling apparatus shown in FIG. 3.

As shown in FIGS. 3 and 4, the mold-cooling apparatus 20 comprises an insert member 26 which is formed into the hole 18 of the bore-forming core pin 16 and which is formed to have a substantially columnar configuration, and a cooling passage 28 which is formed in the insert member 26.

A joint member 38 is inserted into a hole 30 of the mold 10. The joint member 38 is provided with a double tube 36 including an inner tube 32 having a small diameter which communicates with a cooling passage 28 of the insert member 26 for supplying the cooling water (cooling medium) to the cooling passage 28, and an outer tube 34 having a large diameter which communicates with the cooling passage 28 for discharging the cooling water from the cooling passage 28.

Seal members 42, 44*a*, 44*b* for tightly sealing the cavity 12 and a space 40 are installed via annular grooves to the outer circumferential surfaces of the bore-forming core pin 16 and the joint member 38 respectively (see FIG. 1).

The insert member 26 may be made of a metal material such as a copper alloy having good thermal conductivity.

Accordingly, it is possible to further improve the cooling efficiency.

The double tube 36 has an unillustrated inlet port which communicates with the cooling passage 28 for supplying the cooling water to the cooling passage 28, and an unillustrated outlet port which communicates with the cooling passage 28 for discharging the cooling water from the cooling passage 28.

As shown in FIG. 3, the cooling passage 28 includes a first passage 46 which is constituted by the inner tube 32 of the double tube 36 protruding from the joint member 38 and which penetrates in the axial direction of the insert member 26, a second passage 48 which communicates with the first passage 46 and which extends radially outwardly from the center, and a third passage 50 which communicates with the second passage 48 and which is formed helically along the outer circumferential surface of the insert member 26. The terminal end of the third passage 50 is formed to communicate with the passage in the outer tube 34 of the double tube 36 via the space 40 which is formed between the insert member 26 and the joint member 38.

The mold-cooling apparatus 20 is designed such that the directivity of cooling resides in the direction of the second passage 48 extending radially outwardly from the center of the insert member 26, i.e., in the direction of the arrow A. The mold-cooling apparatus 20 is provided so that the cooling efficiency is improved in the direction of the arrow A as compared with the other directions.

Certainly, this arrangement is significant because of the following reason. That is, when the start point of the helically formed third passage 50 is apportioned in an arbitrary direction, a large number of helically circumscribing groove portions are arranged in the apportioned direction. Therefore, the cooling effect can be partially improved corresponding to the shape of the cast product, even for a portion of the mold for forming the thick-walled section of the cast product for which the cooling effect is especially required.

For example, in the case of the mold structure in which the first cavity 22 for forming the thick-walled section of the cast product and the second cavity, 24 for forming the thin-walled section of the cast product are symmetrically arranged, it is preferable to set the mold-cooling apparatus 20 such that the direction of the arrow A is directed to the first cavity 22 for forming the thick-walled section which is difficult to be cooled as compared with the thin-walled section (see FIG. 1).

The helical third passage 50 for constructing the cooling passage 28 is composed of a groove having a substantially semicircular cross section. The groove is formed with a substantially identical cross-sectional area in order to obtain a substantially constant flow velocity at which the cooling water flows.

The mold 10, to which the mold-coling apparatus 20 according to the embodiment of the present invention is applied, is basically constructed as described above. Next, its operation, function, and effect will be explained.

At first, an unillustrated cooling water supply source is connected to the inlet port of the double tube 36, and an unillustrated cooling water storage source is connected to the outlet port. It is assumed that the core pin 16 is arranged in the cavity 12 of the mold 10.

When molten metal (for example, aluminum molten metal) is poured into the cavity 12 of the mold 10, the unillustrated cooling water supply source is driven to supply the cooling water from the inlet, port. The cooling water flows along the inner tube 32 of the double tube 36, and it flows through the first passage 46 extending in the axial direction of the insert member 26. Further, the cooling water flow along the second passage 48 extending radially outwardly from the center at the top of the insert member 26 and along the third passage 50 formed helically on the outer circumferential surface of the insert member 26. The cooling water, which is introduced from the terminal end of the third passage 50, passes through the space 40 formed between the insert member 26 and the joint member 38 and through the outer tube 34 of the double tube 36, and it is discharged from the outlet port to the unillustrated cooling water storage source.

Figure 2:
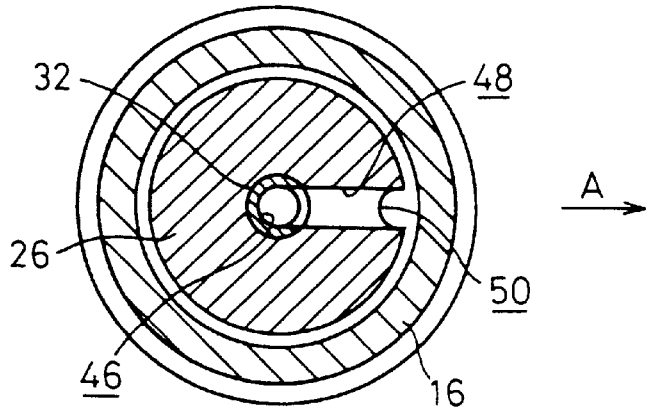
FIG. 2 shows a cross-sectional view illustrating the mold-cooling apparatus provided for the mold.

In this embodiment, as shown in FIG. 2, the directivity of cooling is set in the direction of the second passage 48, i.e., in the direction of the arrow A directed radially outwardly from the center of the insert member 26.

Therefore, for example, when the mold-cooling apparatus 20 is arranged so that the cavity for forming the thick-walled section of the cast product is in the direction of the arrow A, it is possible to improve the cooling efficiency in the direction of the arrow A as compared with the other directions.

In other words, in the mold-cooling apparatus 20, the directivity is set for the side of the first cavity 22 for forming the thick-walled section of the cylinder block. The cooling performance for the thick-walled section is controlled in accordance with the cooling action of the cooling water flowing through the cooling passage 28. Thus, the internal quality of the thick-walled section can be improved, and it is possible to stably obtain the cylinder block having a highly accurate quality.

In the embodiment of the present invention, the contact surface area of the cooling water is decreased by forming the helical cooling passage 28 on the insert member 26. Further, the steam, which is generated by the evaporation of the cooling water, can be easily discharged to the outside by decreasing the flow rate of the cooling water. As a result, the occurrence of misrun or the like is avoided without lowering the cooling ability. Thus, it is possible to obtain the cast product having a highly accurate quality.

Next, FIGS. 5 to 8 show modified embodiments of the groove formed on the outer circumferential surface of the insert member 26. It is assumed that the directivity of cooling is set in the direction of the arrow A in the same manner as described above.

Figure 5:
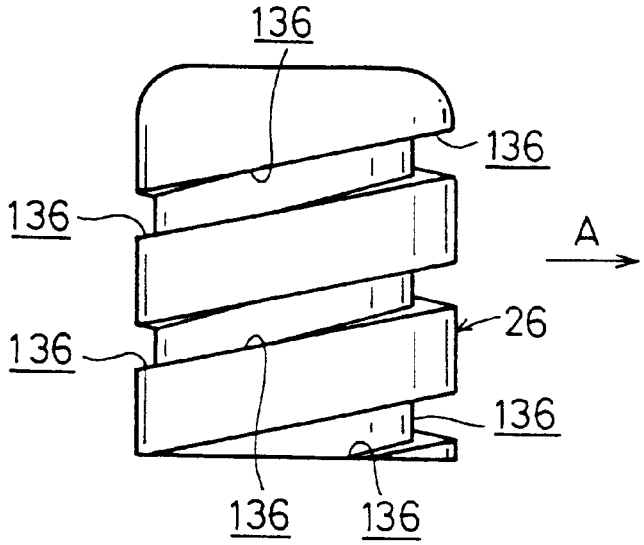
FIG. 5 shows a front view illustrating a first modified embodiment of a groove formed helically on an outer circumferential surface of an insert member.
Figure 6:
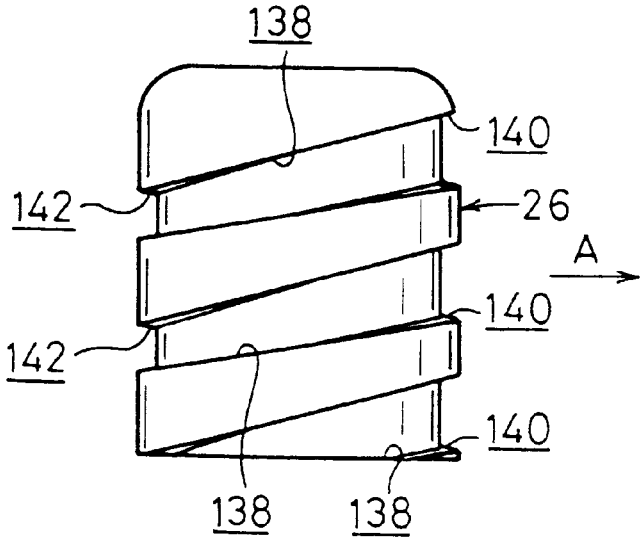
FIG. 6 shows a front view illustrating a second modified embodiment of a groove formed helically on an outer circumferential surface of an insert member.

The first modified embodiment shown in FIG. 5 has the following feature. That is, a third passage 136 is formed by a helical groove which resides in a deep angular groove having a rectangular cross section, and the groove width and the depth of the groove are formed to be substantially constant. The second modified embodiment shown in FIG. 6 has the following feature. That is, a groove portion 140 on the side in the direction of the arrow A, which is a part of a third passage 138, is formed to have a large groove width. In other words, the groove width of the groove portion 140 on the side of the arrow A is set to be slightly larger than the groove width of a groove portion 142 disposed on a side opposite to that in the direction of the arrow A.

Figure 7:
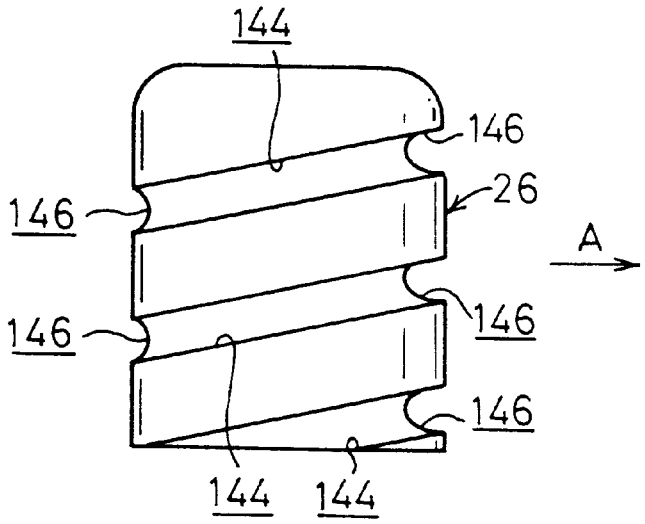
FIG. 7 shows a front view illustrating a third modified embodiment of a groove formed helically on an outer circumferential surface of an insert member.
Figure 8:
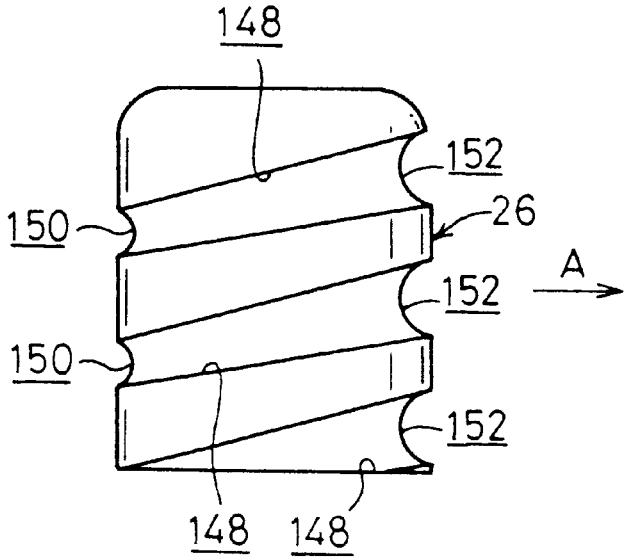
FIG. 8 shows a front view illustrating a fourth modified embodiment of a groove formed helically on an outer circumferential surface of an insert member.

The third modified embodiment shown in FIG. 7 has the following feature. That is, a third passage 144 is formed by a groove 146 which resides in a deep round groove, in place of the groove which resides in the angular groove of the first modified embodiment. Further, the fourth modified embodiment shown in FIG. 8 has the following feature. That is, a third passage 148 is formed by a, deep round groove. The groove width of a groove portion 152 on the side of the arrow A is set to be larger than the groove width of a groove portion 150 disposed on a side opposite to that in the direction of the arrow A.

As described above, the cross-sectional configuration of a part of the groove formed to have the helical configuration may be various cross-sectional configurations including, for example, the round shape and the angular shape. Alternatively, the depth of the groove may be changed. Thus, it is possible to provide the directivity of cooling, and it is possible to freely control the cooling ability. As a result, it is possible to partially increase the cooling performance at the portion which is thermally affected to a great extent during the casting, and it is possible to improve the internal quality of the thick-walled section of the cast product.

Next, FIG. 9 shows experimental results obtained by performing the continuous casting by using the mold 10 applied with the mold-cooling apparatus 20 according to the embodiment of the present invention. Experiments were carried out while the flow velocity for supplying the cooling water to the mold-cooling apparatus 20 was set to be constant at 0.8 liter per minute, 1.1 liter per minute, and 1.6 liter per minute respectively.

In FIG. 9, a solid line A indicates the change of the flow rate in a state in which the flow, rate of the cooling water supplied to the mold-cooling apparatus 20 is constant at a flow velocity of 1.1 liter per minute. A solid line A' indicates the temperature characteristic of the mold 10, obtained when the flow velocity is constant at 1.1 liter per minute.

In FIG. 9, a broken line B indicates the change of the flow rate in a state in which the flow rate of the cooling water supplied to the mold-cooling apparatus 20 is constant at a flow velocity of 0.8 liter per minute. A broken line B' indicates the temperature characteristic of the mold 10, obtained when the flow velocity is constant at 0.8 liter per minute.

In FIG. 9, a dashed line C indicates the change of the flow rate in a state in which the flow rate of the cooling water supplied to the mold-cooling apparatus 20 is constant at a flow velocity of 1.6 liter per minute. A dashed line C' indicates the temperature characteristic of the mold 10, obtained when the flow velocity is constant at 1.6 liter per minute.

In FIG. 9, when the casting is continuously performed, then the Nth casting step is indicated by "Nth", and the followings are continuously represented by "(N+1)th", "(N+2)th", and "(N+3)th".

Figure 10:
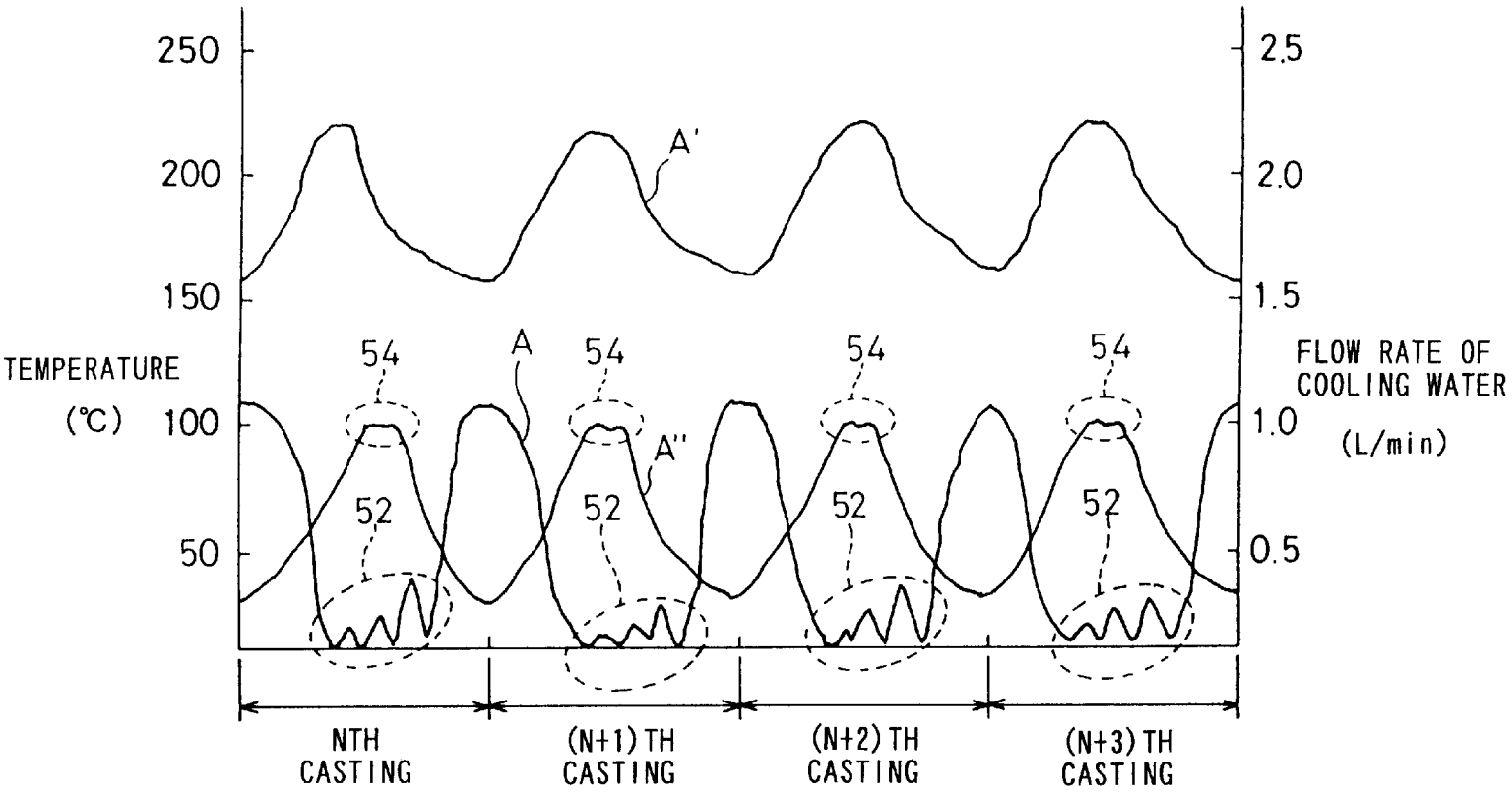
FIG. 10 illustrates a relationship between the temperature and the flow rate of cooling water, obtained when the flow velocity of cooling water is 1.1 liter per minute.

FIG. 10 shows the relationship between the temperature and the flow rate of the cooling water, obtained when the flow velocity of the cooling water is 1.1 liter per minute. In FIG. 10, a solid line A indicates the change of the flow rate in a state in which the flow rate of the cooling water Is supplied to the mold-cooling apparatus 20 is constant at a flow velocity of 1.1 liter per minute. A solid line A' indicates the temperature characteristic of the mold 10, obtained when the flow velocity is constant at 1.1 liter per minute. A solid line A" indicates the temperature characteristic of the cooling water, obtained when the flow velocity is 1.1 liter per minute.

According to the experiments, it has been revealed that the optimum state is obtained when the;flow velocity of the cooling water is set to be 1.1 liter per minute. That is, when the flow velocity of the cooling water is 1.1 liter per minute to give a constant state, and the flow rate of the cooling water is controlled to give a flow rate characteristic curve 52 indicated by the solid line A by performing the on/off switching control for an unillustrated flow rate control valve, then the maximum temperature of the cooling water is held at about 100° C., and an optimum cooling region 54, in which the coefficient of thermal conductivity is large, is successfully set (see the solid line A").

Explanation will now be made for the coefficient of thermal conductivity of the cooling water flowing through the cooling passage 28.

Figure 11:
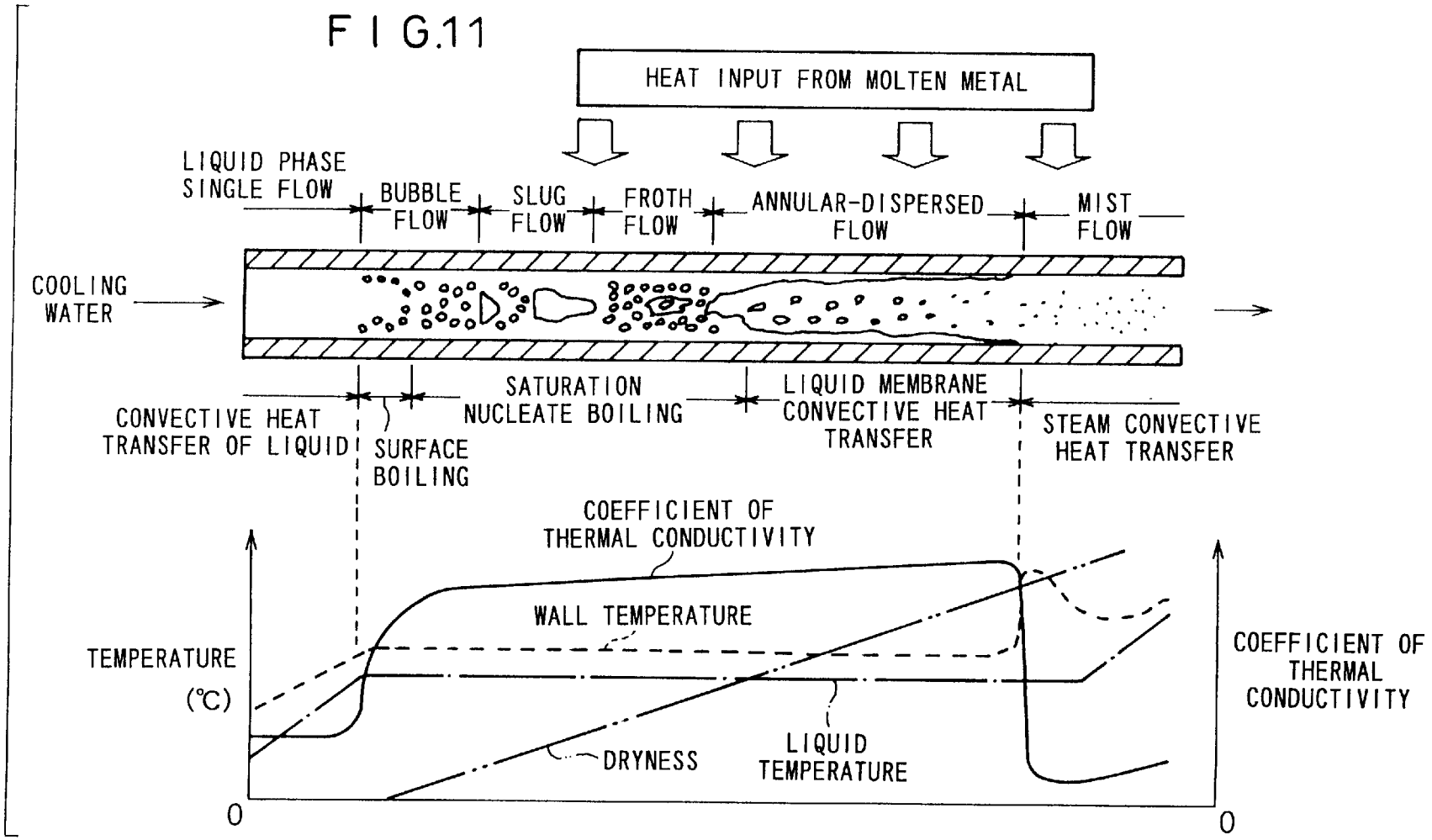
FIG. 11 illustrates the coefficient of thermal conductivity of cooling water.

As shown in FIG. 11, as the temperature is increased, the state of the cooling water is successively changed from the liquid phase single flow to the bubble flow, the slug flow, the froth flow, the annular-dispersed flow, and the mist flow. When the change of state of the cooling water as described above is considered from the viewpoint of the heat transfer mechanism, the change occurs from the convective heat transfer of liquid to the surface boiling, the saturation nucleate boiling, the liquid membrane convective heat transfer, and the steam convective heat transfer.

In this viewpoint, as shown by the characteristic curve of the coefficient of thermal conductivity, the state in which the cooling efficiency is good, i.e., the optimum cooling region in which the coefficient of thermal conductivity is large is located in a range from the surface boiling to the liquid membrane convective heat transfer. It is preferable that the flow rate of the cooling water is controlled so as to be in the range from the surface boiling to the liquid membrane convective heat transfer. In other words, it is preferable that the flow rate of the cooling water is controlled to give the optimum cooling region in which the coefficient of thermal conductivity is large. When the flow rate of the cooling water is controlled as described above to set the optimum cooling region, then the cooling efficiency is improved, and it is possible to obtain the cast product having a highly accurate quality.

When the weight of the cast product to be cast is varied, the flow velocity of the cooling water is increased or decreased corresponding to the varied weight to make-the setting so that the coefficient of thermal conductivity is in the optimum cooling region. Thus, it is possible to is obtain the large coefficient of thermal conductivity and the good cooling efficiency. For example, as shown in FIG. 12, when the weight of the cast product is increased by 400 (g), the optimum cooling efficiency can be obtained by increasing the flow velocity of the cooling water to 1.4 liter per minute.

Figure 12:
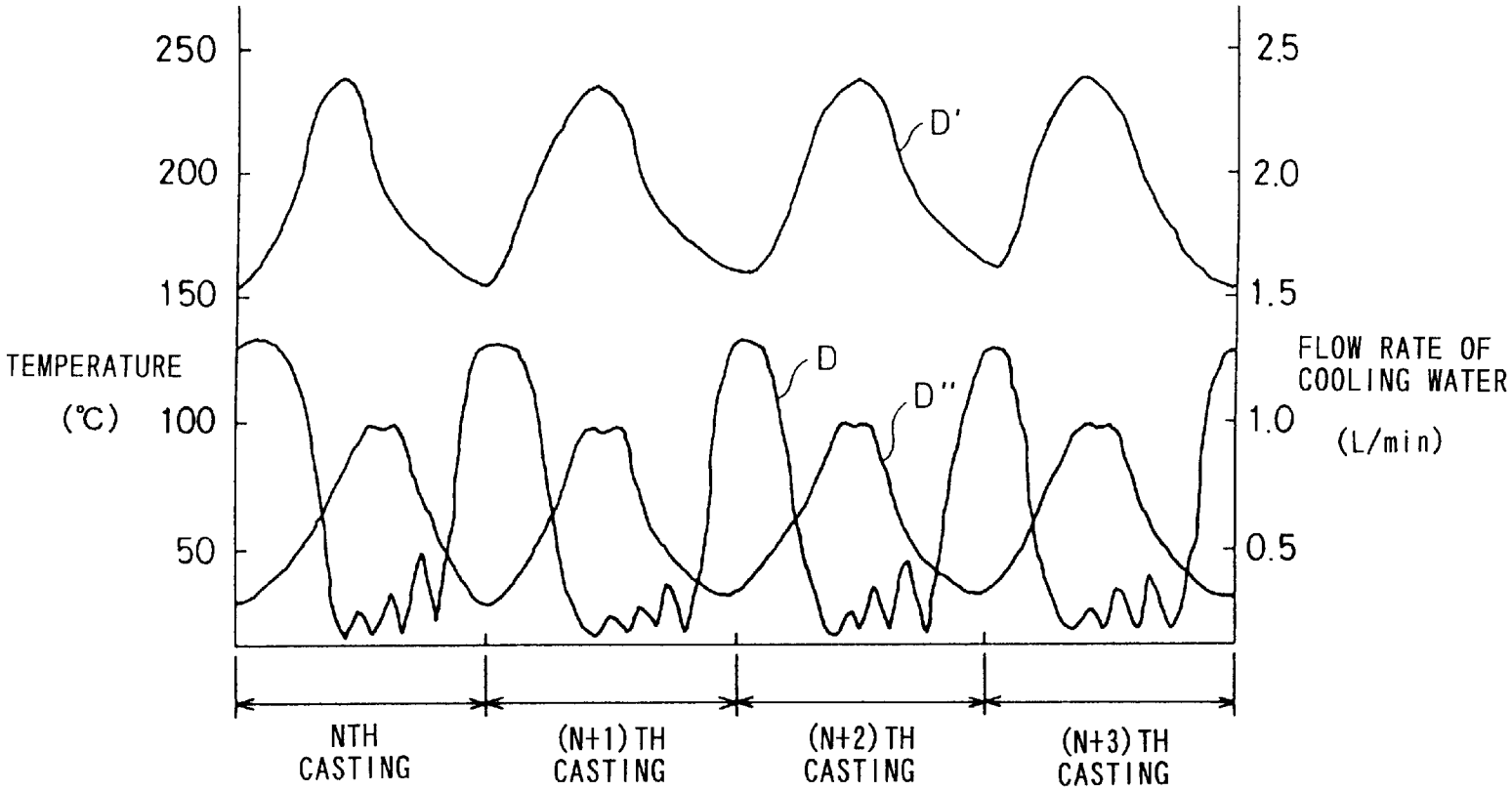
FIG. 12 illustrates a relationship between the temperature and the flow rate of cooling water, obtained when the weight of a cast product is increased.

In FIG. 12, a solid line D indicates the change of the flow rate in a state in which the flow rate of the cooling water supplied to the mold-cooling apparatus 20 is constant at a flow velocity of 1.4 liter per minute. A solid line D' indicates the temperature characteristic of the mold 10, obtained when the flow velocity is constant at 1.4 liter per minute. A solid line D" indicates the temperature characteristic of the cooling water, obtained when the flow velocity is 1.4 liter per minute.

When the flow velocity of the cooling water is controlled to be 1.4 liter per minute corresponding to the variation in weight of the cast product, then as shown by the solid line D", the maximum temperature of the cooling water is held at about 100° C., the coefficient of thermal conductivity is large, and it is possible to obtain the good cooling efficiency.

Figure 13:
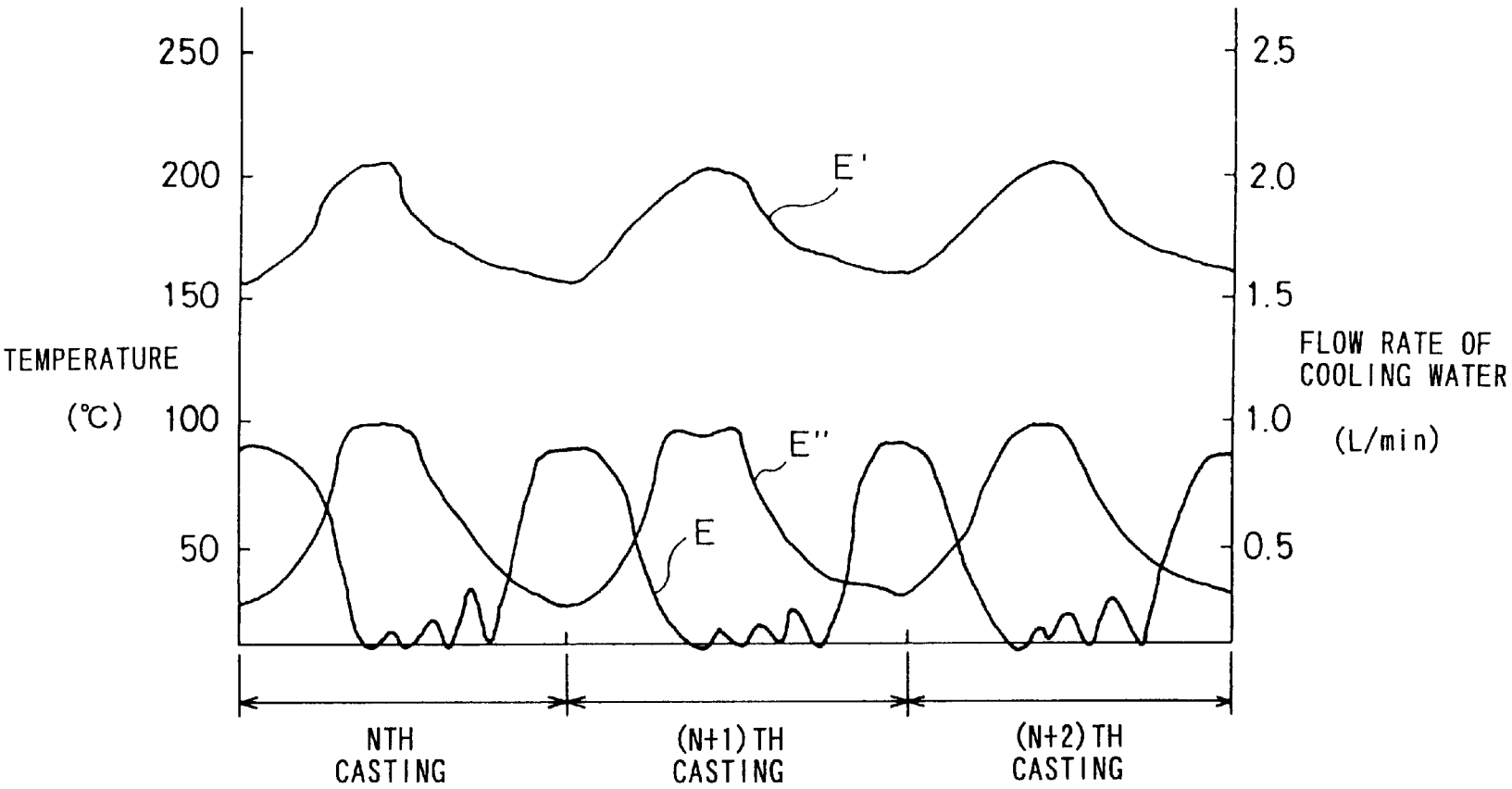
FIG. 13 illustrates a relationship between the temperature and the flow rate of cooling water, obtained when the cycle time of the continuous casting is varied.
Figure 14:
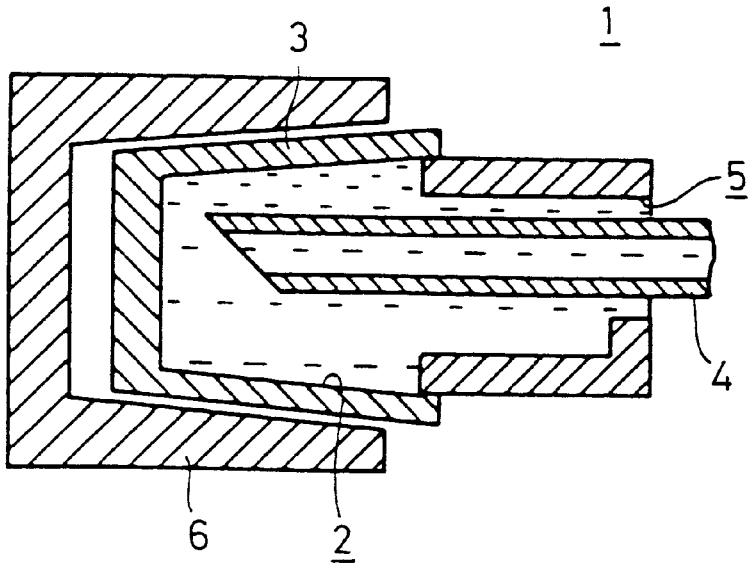
FIG. 14 shows a longitudinal sectional view illustrating a cooling apparatus concerning the conventional technique in which a core pin having a lateral type cooling structure is adopted.
Figure 15:
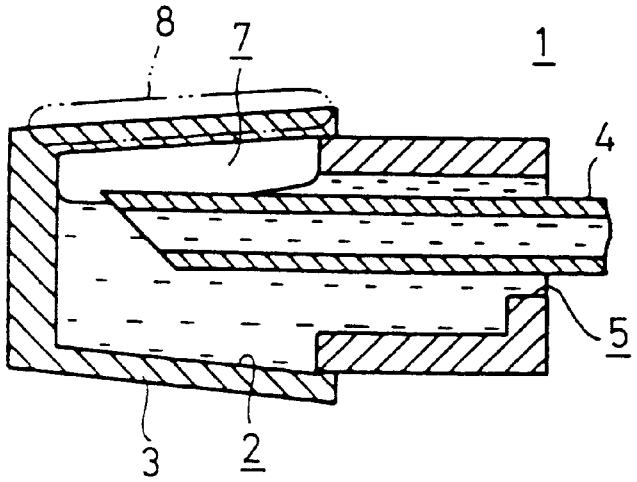
FIG. 15 illustrates the operation of the cooling apparatus concerning the conventional technique shown in FIG. 14.
Figure 16:
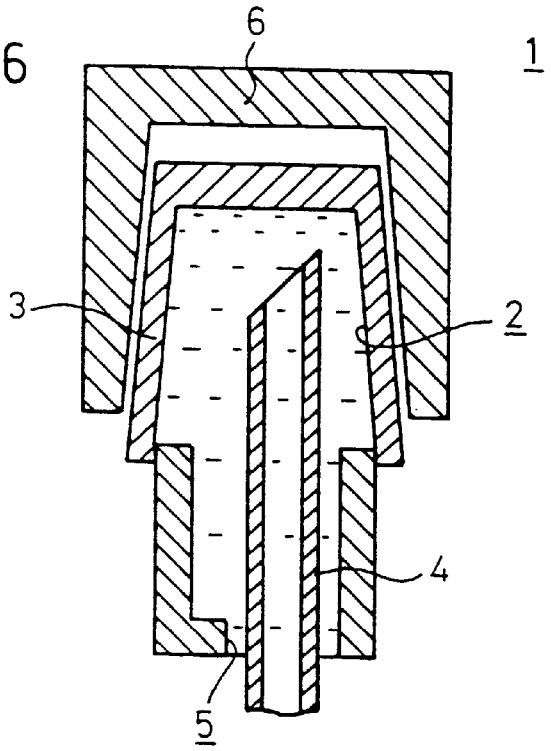
FIG. 16 shows a longitudinal sectional view illustrating a cooling apparatus concerning the conventional technique in which a core pin having a vertical type cooling structure is adopted.
Figure 17:
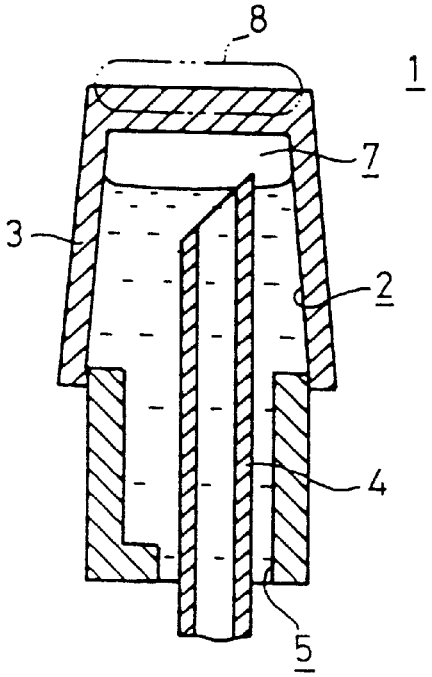
FIG. 17 illustrates the operation of the cooling apparatus concerning the conventional technique shown in FIG. 16.

When the cycle time of the continuous casting is varied, the flow velocity of the cooling water is changed corresponding to the varied cycle time to make the setting so that the coefficient of thermal conductivity is in the optimum cooling region. Accordingly, the coefficient of thermal conductivity is large, and it is possible to obtain the good cooling efficiency. For example, as shown in FIG. 13, when the cycle time is increased by 10 seconds, the flow velocity of the cooling water is decreased to 0.9 liter per minute. Accordingly, it is possible to obtain the optimum cooling efficiency.

In FIG. 13, a solid line E indicate s the change of the flow rate in a state in which the flow rate of the cooling water supplied to the mold-cooling apparatus 20 is constant at a flow velocity of 0.9 liter per minute. A solid line E' indicates the temperature characteristic of the mold 10, obtained when the flow velocity is constant at 0.9 liter per minute. A solid line En indicates the temperature characteristic of the cooling water, obtained when the flow velocity is 0.9 liter per minute.

When the flow velocity of the cooling water is controlled to be 0.9 liter per minute corresponding to the variation in cycle time of the casting, then as shown by the solid line E", the maximum temperature of the cooling water is held at about 100° C., the coefficient of thermal conductivity is large, and it is possible to obtain the good cooling efficiency.

What is claimed is:

1. A mold-cooling apparatus for cooling a mold when casting is performed, said apparatus comprising an insert member inserted into a hole of a core pin incorporated into a cavity of said mold, a helical cooling passage formed on an outer circumferential surface of said insert member for allowing cooling water to flow therethrough, and a helical land portion of said insert member formed adjacent said helical cooling passage, said land portion being disposed in contact with an inner wall surface of said core pin, thereby forming said helical cooling passage-between said insert member and said inner wall surface of said core pin, wherein a start point of said helical cooling passage is set and apportioned in a predetermined direction corresponding to a wall thickness of a cast product having a shape defined by said cavity, wherein a greater volume of cooling water flows on a side of said insert member facing in said predetermined direction.

2. The mold-cooling apparatus according to claim 1. wherein said insert member is made of a metal material containing at least copper alloy.

3. The mold-cooling apparatus according to claim 1, wherein said cooling passage is composed of a groove formed to have a helical configuration along said outer circumferential surface of said insert member having a substantially columnar configuration, and said groove includes an angular groove having a rectangular cross section.

4. The mold-cooling apparatus according to claim 3, wherein a groove width of said groove is set to be larger on said side of the insert member facing in said predetermined direction.

5. The mold-cooling apparatus according to claim 3, wherein a groove depth of said groove is set to be larger on said side of the insert member facing in said predetermined direction.

6. The mold-cooling apparatus according to claim 1, wherein said cooling passage is composed of a groove formed to have a helical configuration along said outer circumferential surface of said insert member having a substantially cylindrical configuration, and said groove includes a round groove having a curved cross section.

7. The mold-cooling apparatus according to claim 6, wherein a groove width of said groove is set to be larger on said side of the insert member facing in said predetermined direction.

8. The mold-cooling apparatus according to claim 6, wherein a groove depth of said groove is set to be larger on said side of the insert member facing in said predetermined direction.

9. The mold-cooling apparatus according to claim 1, wherein said cast product is composed of a cylinder block for constructing an automobile engine, said cylinder block having a thick-walled section and a thin-walled section which are arranged substantially symmetrically, and wherein said predetermined direction is oriented toward said thick-walled section.

10. A mold-cooling method for cooling a mold having an insert member inserted into a hole of a core pin incorporated into a cavity of said mold, in accordance with an action of a cooling medium flowing along a cooling passage when casting is performed, said method comprising the steps of:

forming a helical cooling passage having a helical configuration in said insert member:

forming a helical land portion of said insert member adjacent said helical cooling passage, positioning said insert member inside said core pin such that said land portion is disposed in contact with an inner wall surface of said core pin, thereby forming said helical cooling passage between said insert member and said inner wall surface of said core pin, wherein a greater volume of said cooling medium flows on a side of said helical configuration facing in a predetermined direction of said mold requiring greater cooling; and controlling a flow rate of said cooling medium supplied to said cooling passage so that said cooling medium is in a state which produces optimum cooling.

11. The mold-cooling method according to claim 10, wherein said cooling medium is supplied at a substantially constant flow velocity.

12. The mold-cooling method according to claim 10, wherein said cooling passage is composed of a groove formed to have a helical configuration along an outer circumferential surface of a substantially cylindrical insert member.

13. The mold-cooling method according to claim 10, where said cast product is composed of a cylinder block for constructing an automobile engine, said cylinder block having a thick-walled section and a thin-walled section, and wherein said predetermined direction is oriented toward said thick-walled section.

14. The mold-cooling method according to claim 10, wherein said state which produces optimum cooling includes states of surface boiling, saturation nucleate boiling, and liquid membrane convective heat transfer in which a coefficient of thermal conductivity of said cooling medium is large.

15. A mold-cooling method for cooling a mold having an insert member inserted into a hole of a core pin incorporated into a cavity of said mold when casting is performed, said method comprising the steps of:

forming a helical cooling passage having a helical configuration in said insert member;

forming a helical land portion of said insert member adjacent said helical cooling passage, positioning said insert member inside said core pin such that said land portion is disposed in contact with an inner wall surface of said core pin, thereby forming said helical cooling passage between said insert member and said inner wall surface of said core pin; and allowing cooling water to flow through said helical configuration, wherein a greater volume of cooling water flows on a side of said helical configuration facing in a predetermined direction of said mold which produces a greater wall thickness of a cast product, and a start point of said helical cooling passage faces in said predetermined direction.

* * * * *